US005318461A

United States Patent [19]

Frikkee et al.

[11] Patent Number: 5,318,461

[45] Date of Patent: Jun. 7, 1994

[54] TERMINAL BLOCK ASSEMBLY WITH SLIP-ON MODULE

[75] Inventors: Arian Frikkee; Rudolf Steinmeier, both of Detmold; Bernd Berkow, Lage; Walter Foerster, Dortmund, all of Fed. Rep. of Germany

[73] Assignee: Weidmüller Interface GmbH & Co., Detmold, Fed. Rep. of Germany

[21] Appl. No.: 906,468

[22] Filed: Jun. 30, 1992

[30] Foreign Application Priority Data

Jul. 2, 1991 [DE] Fed. Rep. of Germany ..... 4121836

[51] Int. Cl.[5] ..... H01R 9/22

[52] U.S. Cl. ..... 439/715; 439/620; 439/680; 361/119

[58] Field of Search ..... 361/88, 93, 118, 119; 439/119, 121, 122, 225, 715, 716, 717, 718, 721, 677, 680, 489, 912, 620

[56] References Cited

U.S. PATENT DOCUMENTS 4,328,524 5/1982 Nozick ..... 361/119
4,741,711 5/1988 Singer, Jr. ..... 439/620
4,790,770 12/1988 Klaiber ..... 439/715 X
4,926,149 5/1990 Saens et al. ..... 439/716 X
4,956,747 9/1990 Beer et al. ..... 439/716 X

FOREIGN PATENT DOCUMENTS 3233255 3/1984 Fed. Rep. of Germany .

*Primary Examiner*—Larry I. Schwartz
*Assistant Examiner*—Khiem Nguyen
*Attorney, Agent, or Firm*—Laubscher & Laubscher

[57] ABSTRACT

A terminal block assembly includes a slip-on module removably connected at one end with a terminal block housing, characterized by the provision of a separating device mounted at an accessible point of separation location at the other end of the module for electrically connecting and disconnecting a circuit interrupting device between a pair of terminals on the module respectively. The separating device includes a lever pivotally connected for movement between connect and disconnect positions relative to the slip-on module, the module including projecting portions for partially concealing the lever when in the connect position, thereby to prevent inadvertent displacement of the lever to the disconnect position.

12 Claims, 3 Drawing Sheets

TERMINAL BLOCK ASSEMBLY WITH SLIP-ON MODULE

STATEMENT OF THE INVENTION

A terminal block assembly is provided including a slip-on module connected at one end with the terminal block housing, said module including testing manually-operable disconnector separator means mounted at an accessible disconnect location at the other end of the module for isolating a circuit-interrupting device mounted within the module.

BRIEF DESCRIPTION OF THE PRIOR ART

In the German patent No. DE-3233255 C2, a terminal block assembly including a removable slip-on module is disclosed, wherein to prevent inadvertent undesirable false switching of the separator means, the terminal block housing is widened to define a space for receiving the separator means of the slip-on module. Thus, the separator means is arranged in the terminal block itself. If a row of several terminals is provided, then a common disconnect module may be associated with a larger number of terminals that are adjacent each other. On the one hand, owing to the arrangement of the separator means within the terminal block housing, the danger of inadvertent false switching in this design is reduced; however, on the other hand, the separator means is relatively inaccessible in relation to the entire circuit structure, since the supporting rails that carry the series terminals are normally arranged between the cable ducts (i.e., in the middle of the conductor guide means). In addition to this undesirable inaccessibility, the visibility of the operating state of the disconnect lever is poor, and manual operation of the lever is interfered with. In the event that there is a problem with the circuit-interrupter means, the entire terminal has to be taken out of the terminal station, and its wiring must be disconnected. Furthermore, in the prior system, coding of the modules relative to the housings was not possible.

The present invention was developed to avoid the above and other drawbacks of the prior terminal block arrangements, and to provide an improved slip-on module that is more easily mounted on the terminal block housing and which affords interchangeability of the modules with the housings.

SUMMARY OF THE INVENTION

Accordingly, a primary object of the present invention is to provide an improved terminal block arrangement in which the slip-on module is connected at one end with the terminal block housing, the manually-operable test disconnector separator means for testing the circuit interrupter contained within the module being arranged t other end of the module at a freely accessible location above the electrical conductors and wiring harnesses. Consequently, in the event of a problem with the circuit-interrupter means, the module may be easily removed for repair or replacement without removal of the terminal block.

According to another object of the invention, the terminals of the terminal block housing are contained in sockets that are received in corresponding bores contained in the adjacent end of the slip-on module, which sockets have external projections and/or grooves that correspond with similar grooves and/or projections contained in the module bores, respectively, thereby to prevent mismatching of the various modules with the terminal block housings, respectively.

According to another object, test openings are provided both in the housing and in the module for receiving test probes to determine the conductive or non-conductive status of the conductors and/or interrupter devices contained in the components.

A further object of the invention is to provide on the terminal block housing an upwardly extending guide portion that is connected with the adjacent narrow edge side wall of the slip-on module by guide means, such as tongue and groove or dovetail guide means, whereby reliable mounting of the module with proper alignment of the cooperating terminals on the respective components is afforded.

BRIEF DESCRIPTION OF THE DRAWINGS

Other objects and advantages of the invention will become apparent from a study of the following specification, when viewed in the light of the accompanying drawings, in which.

DETAILED DESCRIPTION

Figure 1:
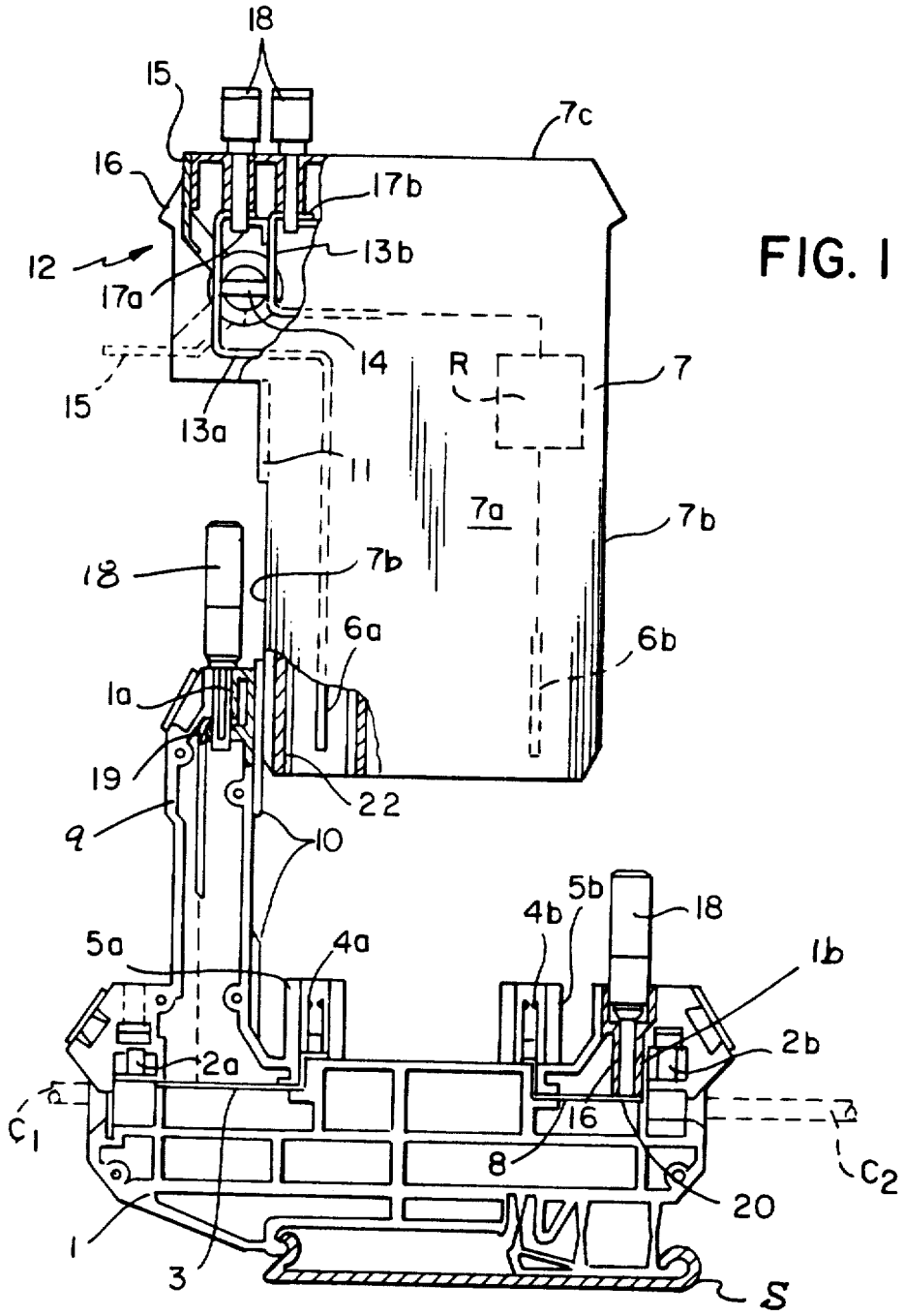
FIG. 1 is a longitudinal sectional view, with certain parts partially broken away, of the terminal block assembly with the slip-on module partially removed from the terminal block housing.

Referring first more particularly to FIG. 1, the terminal block assembly of the present invention includes a terminal block housing 1 having an input electrical connector 2a connected with one end of a first conductor $C_1$, and an output connector 2b connected with one end of a second conductor $C_2$. A bridging conductor 3 electrically connects the input connector 2a with one contact 4a of a first pair of contacts, the other contact 4b of this pair being connected by bridging conductor 8 to output connector 2b. The pair of terminals 4a and 4b are contained in upwardly projecting socket portions 5a and 5b of the housing, respectively. The terminals 4a and 4b are female terminals adapted for connection with a second pair of male terminals 6a and 6b, respectively, which terminals are contained in corresponding bores 22 provided in the lower end of the removable slip-on module 7. The slip-on module 7 includes a body member having a generally rectangular transverse cross-sectional configuration having a pair of opposed relative wide vertical side walls 7a, a pair of opposed relatively narrow vertical side walls 7b, and a horizontal top wall 7C.

The housing 1 includes an upwardly projecting guide portion 9 that includes on the side thereof adjacent the slip-on module 7 female dovetail guide means 10 that cooperate with corresponding male dovetail guide means 11 on the adjacent face of the slip-on module, thereby to guide the slip-on module for vertical movement relative to the housing 1. Thus, when the slip-on module is displaced downwardly, the second pair of contacts 6a and 6b are guided for insertion within the female contacts 4a and 4b, respectively, and the upwardly extending sockets 5a and 5b are guided for insertion within the corresponding bores 22, respectively, contained in the lower end of the removable slip-on module 7.

Figure 4:
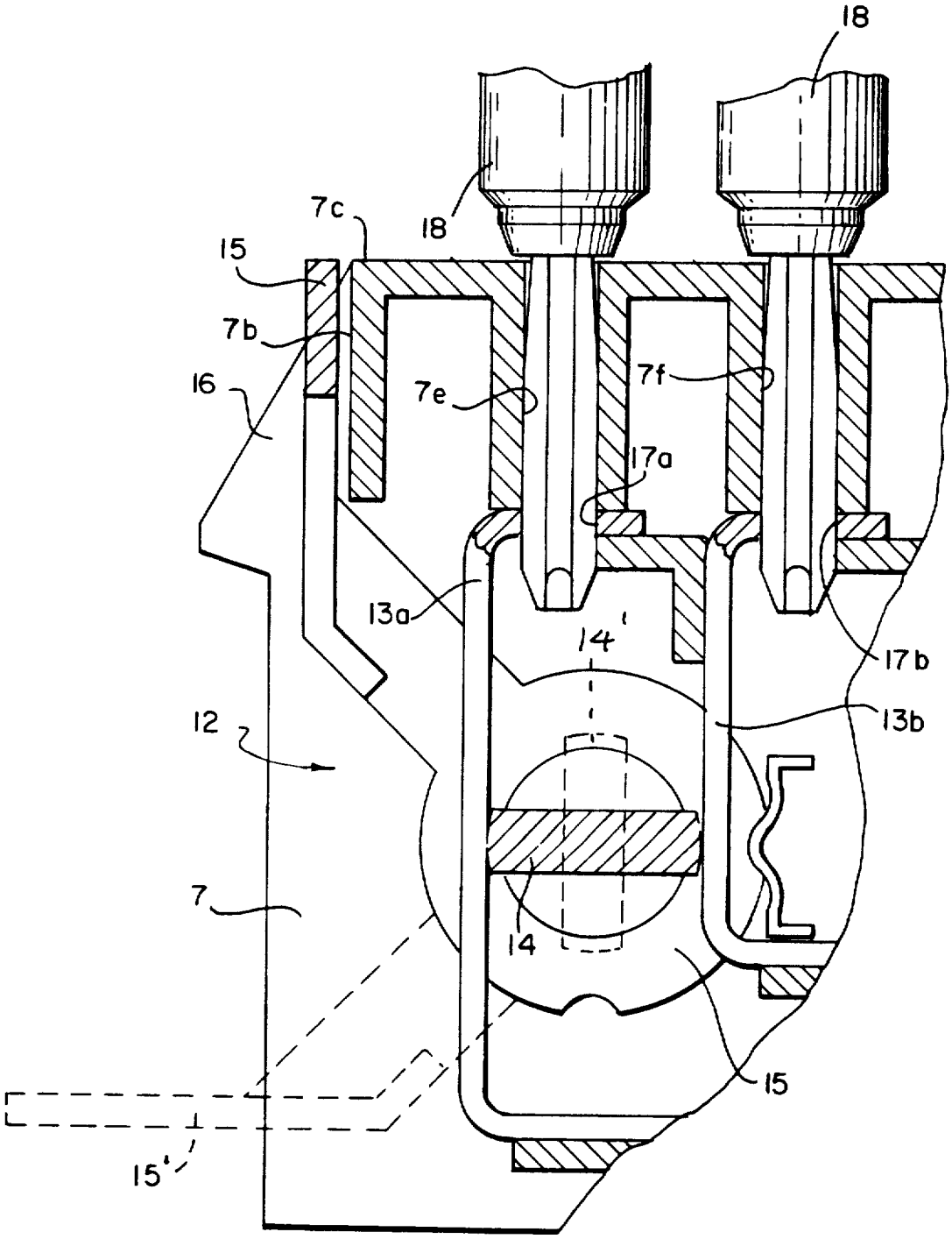
FIG. 4 is a detailed sectional view of the point of separation portion of the slip-on module.

In accordance with a characterizing feature of the present invention, the manually-operable test disconnect or separator means 12 of the slip-on module are arranged at a test separator location at the upper left hand corner of the slip-on module, thereby to afford an accessible location of the separator means relative to the housing 1 and the conductors associated therewith. Bus bars 13*a* and 13*b* are rigidly mounted within the slip-on module 7, the bus bar 13*a* being directly connected with the terminal 6*a* and the bus bar 13*b* being connected with terminal 6*b* via a relay R, electronic switch, or the like contained in the slip-on module. The separator means for isolating the relay during test includes a disconnect contact 14 provided on a disconnect lever 15 that is pivotally connected with the slip-on module 7, which lever is pivotable from its illustrated "connect" position to the "disconnect" position shown in phantom, whereupon during testing of the slip-on module, the disconnect contact 14 is displaced from its illustrated contact position electrically bridging the bus bars 13*a* and 13*b* to the disconnect position shown in phantom in FIG. 4. In order to protect the disconnect lever against inadvertent undesirable pivotal movement from the connect position to the disconnect position, the slip-on module 7 is provided with lateral projections 16 on the each side of the lever, thereby to partially conceal the same when in the illustrated connect position.

In accordance with another feature of the invention, the upper end of the slip-on module is provided with test bores 7*e* and 7*f* (FIG. 4) affording access to test points 17*a* and 17*b*, respectively, by the test probes 18. Similarly, the housing 1 of FIG. 1 is provided with test bores 1*a* and 1*b* that afford access to test contacts 19 and 20 associated with the bridging conductors 3 and 8, respectively.

Figure 2:
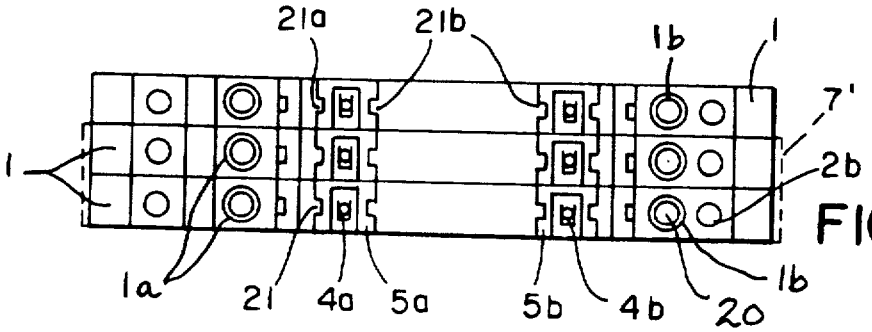
FIG. 2 is a top plan view of a plurality of the terminal block housings arranged in side-by-side relation.
Figure 3:
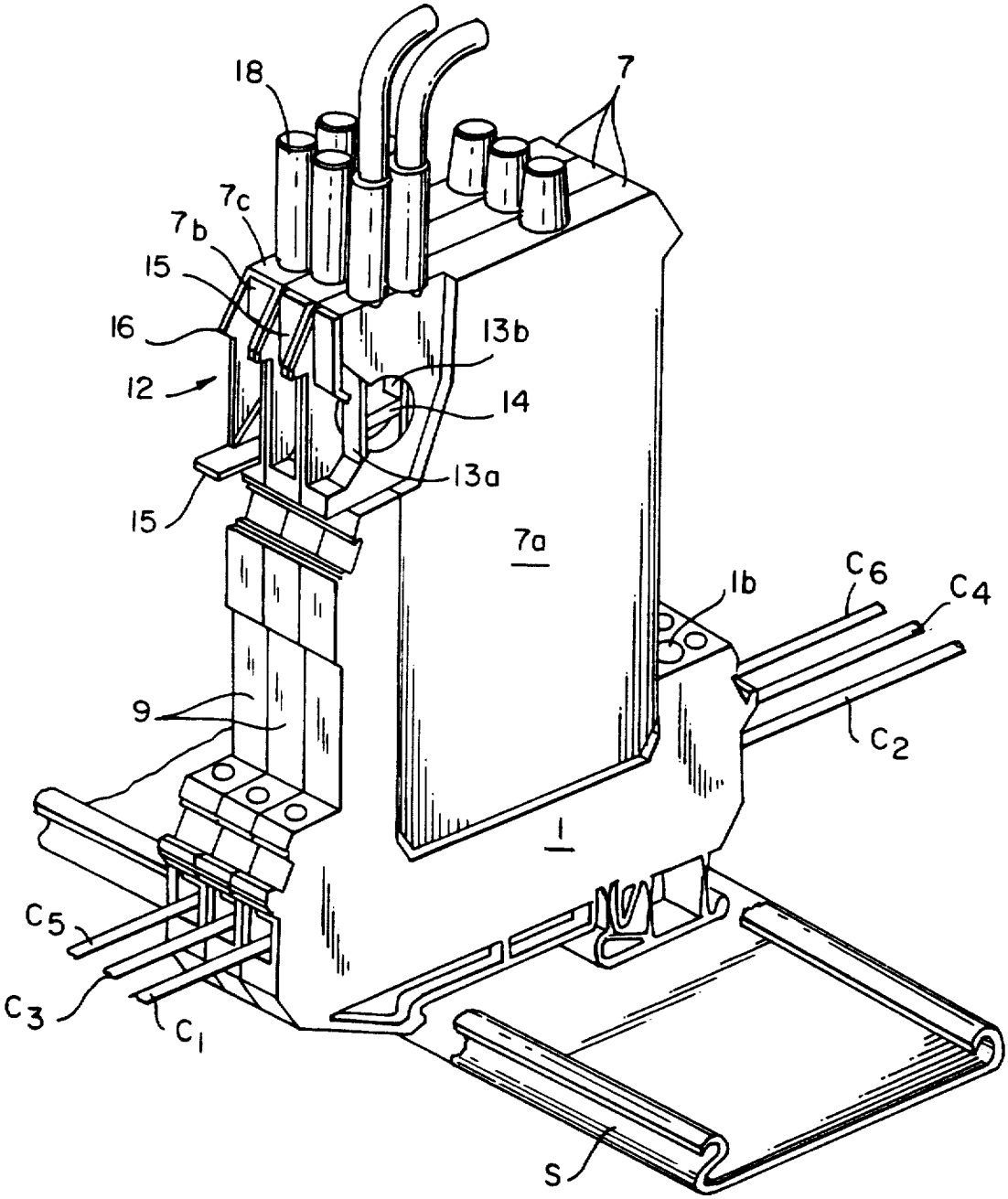
FIG. 3 is a perspective view illustrating a plurality of the terminal block assemblies arranged on a mounting rail.

As shown in FIG. 3, a plurality of the terminal block assemblies may be mounted in side-by-side relation on support rail means S. As shown in this figure, the test disconnect means 12 of each slip-on module is arranged at an accessible location above the conductor means C1-C6 and the associated cable harness means (not shown), the test disconnect means 12 being above the guide projections 9 on the terminal block housing 1, respectively. As shown in FIG. 2, the sockets 5*a* and 5*b* may be provided with external dovetail grooves 21*a* and 21*b* that are coded in size and/or configuration relative to the corresponding dovetail means on the walls of the bores contained at the lower ends of the slip-on modules 7, respectively, thereby to prevent mismatching of any given module relative to its associated terminal block housing. Also, it is possible as shown in FIG. 2, to have one slip-on module 7' connected with two or more of the terminal block housings 1.

As described above, when a common oversize slip-on module 7' is used in connection with a plurality of housings 1, a simplified structure is provided which results in a relatively large interior space for the oversize slip-on module, for example, in the form of a standardized relay.

While in accordance with the provisions of the Patent Statutes the preferred forms and embodiments have been illustrated and described as set forth in the above specification.

What is claimed is:

1. A terminal block arrangement for connecting and disconnecting a pair of conductors ($C_1$,$C_2$), comprising:

(a) a terminal block housing (1) formed from an electrical insulating material and including a pair of adjacent spaced first electrical terminals (4*a*, 4*b*) adapted for connection with said conductors, respectively;

(b) a generally rectangular slip-on module (7) having at one end a pair of spaced second electrical terminals (6*a*, 6*b*) said module being mounted on said housing with said second electrical terminals in electrical contact with said first terminals, respectively, said slip-on module containing circuit-interrupting means (R) connected between said second electrical terminals; and (c) test disconnect means (14,15) arranged at a disconnect location (12) adjacent the other end of said slip-on module for isolating said circuit-interrupting means from at least one of said second terminals, said test separator means including:

(1) a pair of stationary parallel spaced bus bars (13*a*, 13*b*) one of which is connected with one of said first terminals, said circuit-interrupting means being connected between the other of said bus bars and the other of said second terminals;

(2) a movable disconnect contact (14) operable between connect and disconnect positions in electrically connecting and isolating conditions relative to said bus bars, respectively; and (3) lever means (15) pivotally connected with said module for pivoting said disconnect contact between its connect and disconnect positions, respectively, said lever being adjacent said module when said disconnect contact is in the connect position relative to said bus bars, said lever extending outwardly from said module when said contact is in the disconnect position.

2. Apparatus as defined in claim 1, wherein said module body includes laterally projecting portions (16) on opposite sides of said lever for partially concealing said lever when said separator contact is in the connect position.

3. A terminal block arrangement for electrically connecting and disconnecting a pair of conductors ($C_1$, $C_2$), comprising:

(a) a terminal block housing (1) formed from electrical insulating material and including a pair of adjacent spaced first electrical terminals (4*a*, 4*b*) adapted for connection with said conductors, respectively; and (b) slip-on module means (7) connected with said terminal block housing, said module means including:

(1) a body member having first and second ends;

(2) a pair of second terminals (6*a*, 6*b*) arranged at said first body end, said module means being mounted on said housing with said second electrical terminals in electrical contact with said first terminals, respectively;

(3) an electrical component (R) arranged within said body member, said component normally being electrically connected between said second terminals; and (4) test disconnect means (12) arranged at said second body end for electrically disconnecting and isolating said electrical component from at least one of said second terminals, whereby the electrical component may be tested at an accessible location without separation of the module from the terminal block, and upon the detection of a defective component, the module containing the defective component may be replaced by an interchangeable like module without removal of the terminal block from the terminal arrangement.

4. Apparatus as defined in claim 3, wherein said body member has a rectangular transverse cross sectional configuration, thereby to define a pair of opposed relatively wide side walls (7*a*), and a pair of relatively narrow side walls (7*b*), said test disconnect means also being adjacent one of said relatively narrow side walls.

5. Apparatus as defined in claim 4, wherein said housing includes at least one guide portion (9) that extends adjacent and parallel with said one narrow body side wall, and guide means (10,11) arranged on adjacent regions of said guide portion and said one narrow side body wall for guiding said module for longitudinal displacement relative to said guide portion.

6. Apparatus as defined in claim 5, wherein said first terminals are mounted within spaced sockets (5) that extend parallel with said housing guide portion, respectively, and corresponding guide means (21,22) on said sockets and on said module, respectively, for guiding said module for longitudinal displacement relative to said sockets.

7. Apparatus as defined in claim 3, wherein said module body second end contains at least one test opening (7*e*,7*f*) for receiving test probe means to test the operation of said test disconnect means.

8. Apparatus as defined in claim 5, wherein said housing contains test openings (1*a*,1*b*) for testing conductor test portions (19,20) associated with said first terminals, respectively.

9. Apparatus as defined in claim 8, wherein one of said housing test openings (1*a*) is contained in said housing guide portion (9).

10. Apparatus as defined in claim 3, and further including means (S) for connecting together in side-by-side relation a plurality of said housings.

11. Apparatus as defined in claim 10, wherein one of said modules (7') is connected with the first terminals of a plurality of said housings.

12. A terminal block arrangement for electrically connecting and disconnecting a pair of conductors ($C_1$,$C_2$), comprising:

(a) a terminal block housing (1) formed from electrical insulating material and including a pair of adjacent spaced first electrical terminals (4*a*,4*b*) adapted for connection with said conductors, respectively; and (b) slip-on module means (7) connected with said terminal block housing, said module means including:

(1) a body member having first and second ends;

(2) a pair of second terminals (6*a*,6*b*) arranged at said first body end, said module means being mounted on said housing with said second electrical terminals in electrical contact with said first terminals, respectively;

(3) an electrical component (R) arranged within said body member, said component normally being electrically connected between said second terminals; and (4) test disconnect means (12) arranged at said second body end for electrically disconnecting and isolating said electrical components from at least one of said second terminals; said test disconnect means including:

(1) a pair of stationary parallel spaced bus bars (13*a*, 13*b*) one of which is connected with one of said second terminals, said electrical component being connected between the other of said bus bars and the other of said second terminals; and (2) a movable disconnect contact (14) operable between connect and disconnect positions for electrically connecting and disconnecting said bus bars, respectively.

* * * * *